US005368111A

United States Patent [19]

Benoit et al.

[11] Patent Number: 5,368,111

[45] Date of Patent: Nov. 29, 1994

[54] DIRECTIONAL DRILLING SUB WITH IMPROVED MULTI-SLOT LOCKING ARRANGEMENT

[76] Inventors: Lloyd F. Benoit; Joseph A. Benoit, both of P.O. Box 503, Arnaudville, La. 70512

[21] Appl. No.: 79,126

[22] Filed: Jun. 16, 1993

[51] Int. Cl.[5] ..... F21B 7/08

[52] U.S. Cl. ..... 175/74; 175/256

[58] Field of Search ..... 175/61, 73, 74, 234, 175/256; 285/184, 185

[56] References Cited

U.S. PATENT DOCUMENTS

| | | | |
|---|---|---|---|
| 4,076,084 | 2/1978 | Tighe | 175/61 X |
| 4,220,214 | 9/1980 | Benoit | 175/61 |
| 4,303,135 | 12/1981 | Benoit | 175/73 |
| 4,834,196 | 5/1989 | Falgout, Sr. | 175/74 |
| 4,928,776 | 5/1990 | Falgout, Sr. | 175/73 X |

*Primary Examiner*—David J. Bagnell

*Attorney, Agent, or Firm*—Pravel, Hewitt, Kimball & Krieger

[57] ABSTRACT

A directional drilling apparatus includes a two part tubular body including an upper section and a lower section adapted to rotate with respect to one another, the upper section including threads for attaching the apparatus to a drill string, the upper section including at its lower end portion a slot including a straight portion which is generally aligned with the axis of the upper section and an offset portion which is spaced laterally from an spaced radially from the vertical section, connecting teeth for forming a connection which rigidly affixes each of the upper and lower section with respect to each other so that they are prevented from rotating with respect to one another, and a sleeve carried by the lower section and slidably movable with respect to the upper section, the sleeve including a locking pin which extends into the slot, the pin being adapted to move longitudinally and laterally within at least a portion of the slot and into either the vertical or laterally offset a section thereof.

13 Claims, 7 Drawing Sheets

11
12
13
30
35
60
10
A

DIRECTIONAL DRILLING SUB WITH IMPROVED MULTI-SLOT LOCKING ARRANGEMENT

BACKGROUND OF THE INVENTION

1. Field of the Invention

The present invention relates to oil well drilling and more particularly relates to directional drilling. Even more particularly the present invention relates to the use of an improved two-part locking slot with a two-section "sub" which operates in combination with, for example, a conventional turbodrill wherein in the invention the "sub" movably shifts from a first position in which the turbodrill is substantially axially aligned with the drill string, to a second or "bent" position whereby a deflection is created between the drill string and the turbodrill of a desired degree.

2. General Background

Although wellbores are normally planned to be drilled vertically, many occasions arise when it is necessary or advantageous to drill at an angle from the vertical. Controlled directional drilling, as it is referred to in the art, makes it possible to reach subsurface points laterally remote from the point where the drill bit enters the earth. Some examples of the use of directional drilling are inaccessible locations (such as under rivers or like bodies of water when the drilling begins on land), salt dome control, relief well control, edgewell control, fault plane control and property line control. Additionally, directional drilling is employed in offshore applications where all the drilling necessarily must take place from a fixed platform in a location in the offshore waters. A further application of directional drilling is seen when obstructions prevent a substantially vertical well direction.

One method of directionally drilling wells is a whipstock method. Another, very popular, method employs a turbodrill in combination with a bent sub assembly. The turbodrill is a conventional device which uses fluid that is pumped under pressure through the center of the motor directed downwardly through void areas between a "rotor" and the rubber-lined spiral passageway of an outer "stator". In order for the flow to occur, the rotor is displaced and turned within the stator by the pressure of the fluid column, thus powering the connecting rod, a hollow drive shaft, and finally a conventional bit sub at the end of the tool.

One such manufactured turbodrill is the "Dyna-Drill" which was introduced in or about 1964. Operation and use of the "Dyna-Drill" for directional drilling can be found in "Dyna-Drill Handbook" (second edition) distributed by Dyna-Drill Division of Smith International, Inc., P. O. Box 327, Long Beach, Calif. 90801. In drilling, a "sub" is a short threaded piece of drill pipe used to connect together parts of the drilling string which could not otherwise be screwed together because of difference in thread size or design.

In the case of directional drilling, the "sub" is bent to produce the desired angle between the lower portion of the drill string (a non-magnetic survey collar normally being the lowermost portion of the drill string which attaches to the sub) and the turbodrill, "Dyna-Drill", or the like which attaches to the opposite end of the sub (this general arrangement is illustrated in FIG. 1 of applicant's U.S. Pat. No. 4,220,214, issued Sep. 2, 1980, wherein a conventional permanently bent sub if the prior art is illustrated). In U.S. Pat. No. 4,303,135, entitled "Directional Drilling Sub", a variable angle adjustment for a directional drilling sub is disclosed. U.S. Pat. Nos. 4,220,214 and 4,303,135 are hereby incorporated herein by reference.

The use of a fixed or non-shifting bent sub requires that the drill string be lowered into the well from the surface with the bent sub creating a kink in the lowermost portion of the drill string, which kink causes problems in lowering the turbodrill into the well. Since the turbodrill is of some length (a length of thirty feet being exemplary), even a small degree of being in the sub can create a relatively large eccentricity in the drill string.

Many patents have been issued which are directed to the problem of directional drilling. Most of these patents provide structures which are directed to solving the problem of effecting the direction of drilling itself, but do not completely and satisfactorily solve the problem of lowering the turbodrill and bent sub in the "kinked" position into the well or lowering it in an "unkinked" position and then allowing for later deviation when "down in the hole".

SUMMARY OF THE PRESENT INVENTION

The present invention in its preferred embodiment provides a variable directional angle drilling sub which shifts upon actuation of the attached turbodrill (first embodiment) or a surface-generated electrical signal (second embodiment) effecting a change in orientation of the sub from a first position in which the drill string and the turbodrill are axially aligned to a second position in which the drill string and turbodrill are deflected with respect to one another, forming a selected one of a possible number of desired angles for directional drilling. An improved locking arrangement uses a combination of drill rotation and pressure on the drill by lifting or lowering the drill string to move the device into selected "straight drill" or "directional drill" positions.

The apparatus of the present invention in this first embodiment comprises generally an upper, tubular section having an attachment at one end portion thereof, which attachment provides, for example, a threaded connection which can attach to a conventional drill string, or to a non-magnetic survey or "Monel" collar or the like. The inner portion of the upper, tubular section is provided with a sliding sleeve, the sleeve having connected to its outermost end portion a threaded or like connection member for attachment to a lower section. This lower section (to which a turbodrill is attachable) and the sleeve to which it is attached are movable with respect to the upper, tubular section both slidably and rotatably within certain limits. This movable connection member thus can be extended and retracted with respect to the upper, tubular section or rotated with respect thereto.

The movable connection member nearest the turbodrill is provided with locking lugs which cooperate with corresponding recesses on the upper, tubular section. When the movable connection member slides with the attached sleeve to an extended position, rotation is free through the desired arcuate path effecting the "shift" from a first "aligned" position to a second, selected "bent" position. In such an extended posture, the lugs clear the corresponding recesses of the upper, tubular section. Likewise, when the sliding sleeve allows the movable connection member to retract into the upper, tubular section, the lugs form a fixed non-rotating locking connection with the upper, tubular section.

Rotation of the movable lower connection member (to which the turbodrill is connected) effects a change in axial orientation of the rotating connector and its attached turbodrill with respect to the drill string. Thus, a rotation through an arcuate path shifts the turbodrill from an axially aligned position with the drill string to a non-axially or deflected position with the drill string, which second or "bent" position is desirable for controlled, directional drilling.

The apparatus of the second embodiment of the present invention provides an indicator designed and adapted to be lowered with a bent-sub tool. It informs the driller on the surface of the position of the tool, i.e. whether it is straight or bent. When the tool is in a straight position, fluid is allowed to flow through and around a valve disc. When the tool is moved into the bent position, locking jaws press down on pushrods, forcing locking pistons out and allowing mud pressure to force a restricting piston down until the valve disc seats upon a valve seat. This forces drilling mud through a jet. This restricts flow which increases mud pressure on a pump gauge at the surface. This increase in mud pressure thus assures the driller that the tool is in the bent-sub position so that drilling can continue.

When the tool is moved back to a straight position, the above procedure is reversed, and a decrease in mud pressure informs the driller at the surface that the tool has been moved back to a straight position.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 1:
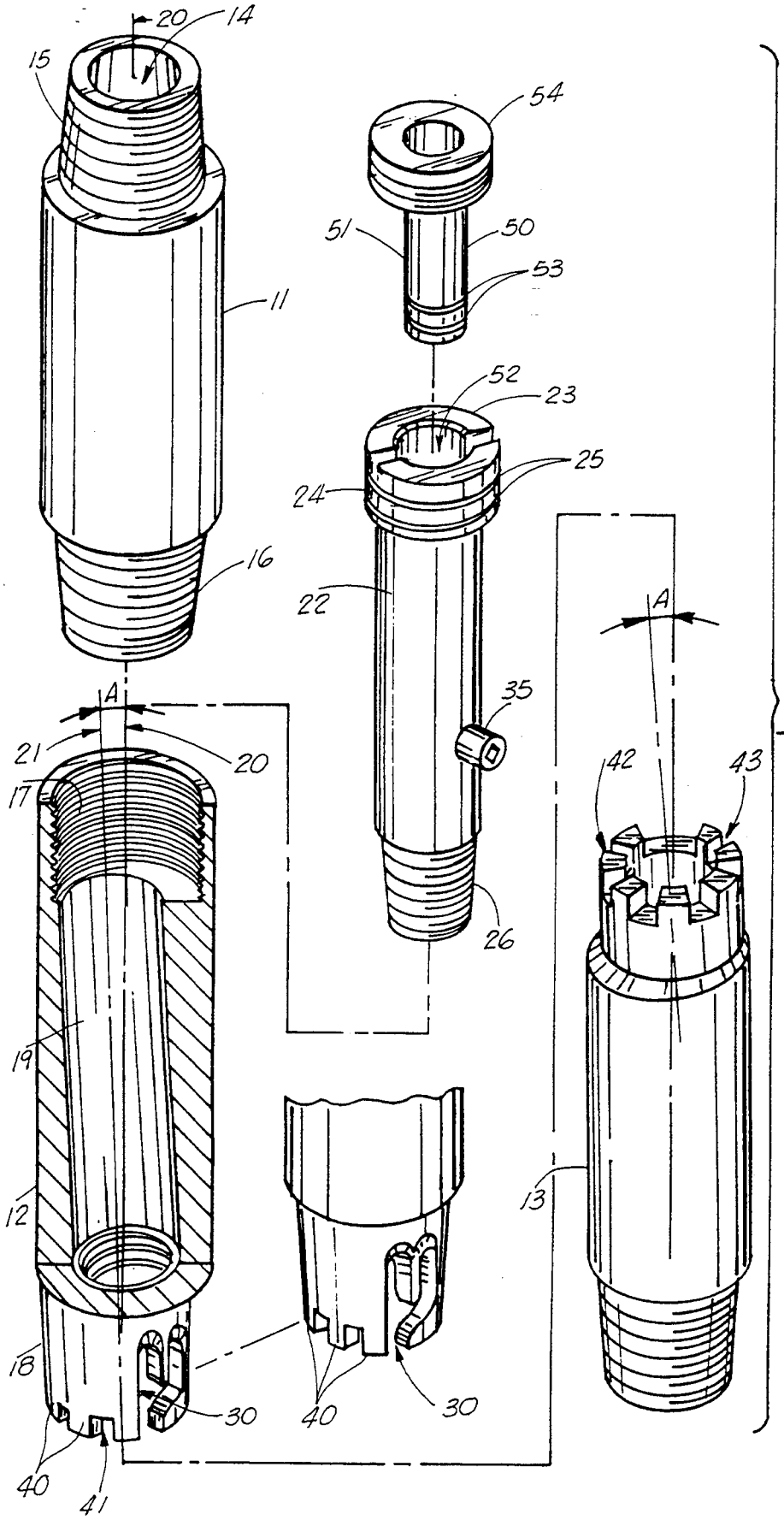
FIG. 1 is an exploded perspective view of the preferred embodiment of the apparatus of the present invention.
Figure 2:
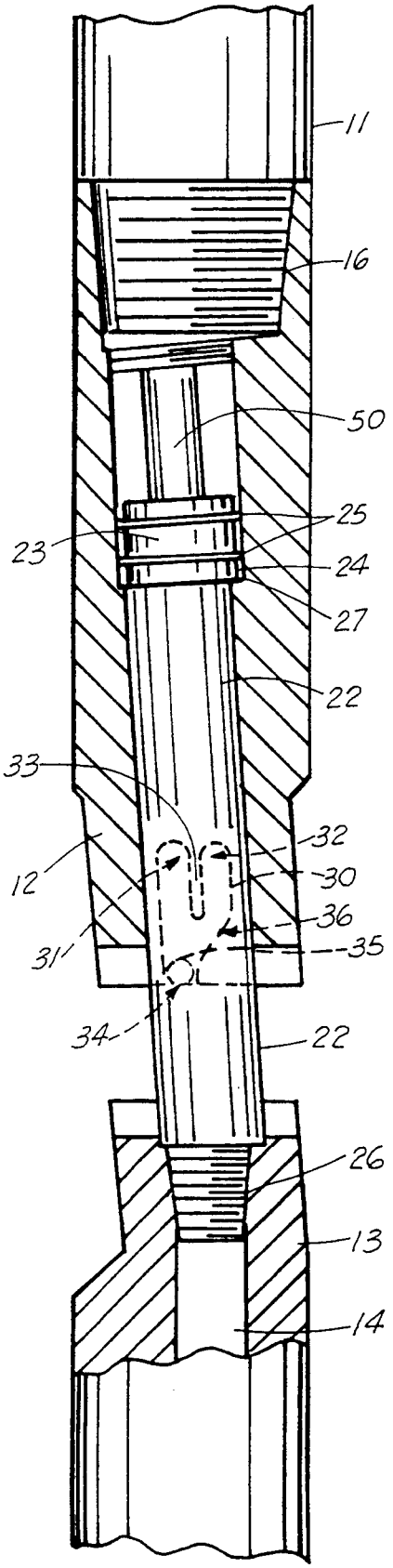
FIG. 2 is a sectional elevational view of the preferred embodiment of the apparatus of the present invention showing the apparatus in an extended position.
Figure 3:
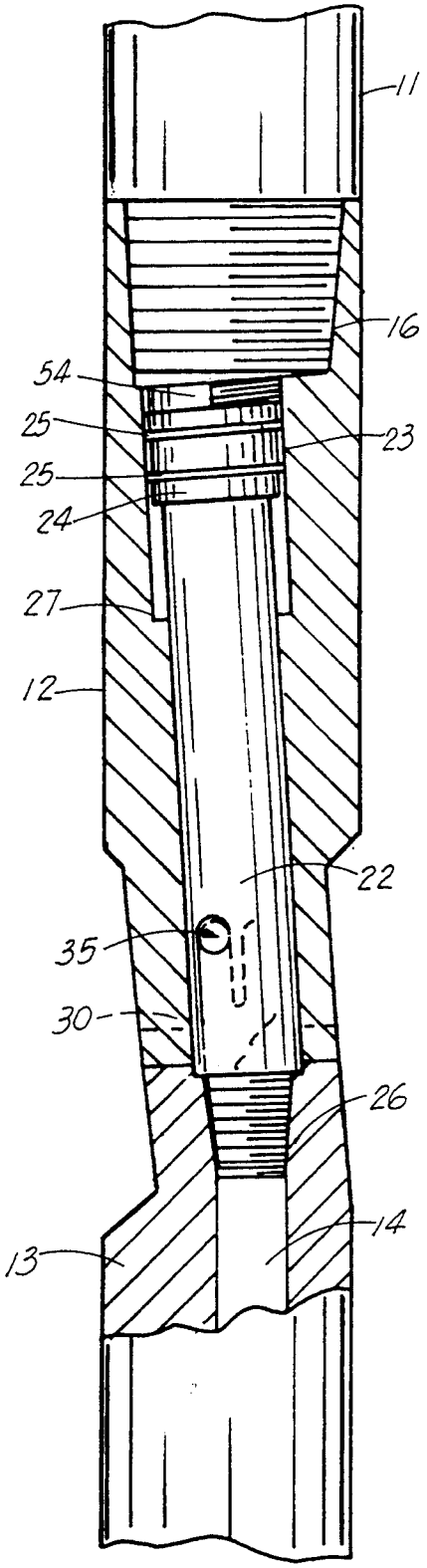
FIG. 3 is a sectional elevational view of the preferred embodiment of the apparatus of the present invention showing the apparatus in a locked position.

FIGS. 1–3 best illustrate the preferred embodiment of the apparatus of the present invention designated generally by the numeral 10. Drilling apparatus 10 includes a tubular body having multiple sections. The tubular body includes an uppermost section 11, a middle section 12, and a lower section 13. Uppermost section 11 includes a tubular bore 14 which is continuous throughout the section. The end portions include threaded section 15 and threaded section 16 which adapt the body 11 for attachment to a drill string. The section 12 includes an uppermost threaded portion 17 which is adapted to form a threaded connection with the threads 16 of section 11, as best seen in FIG. 2. The section 12 includes a lowermost end portion 18 having a plurality of radially spaced locking teeth which can form a connection with similar locking teeth on the section 13, as will be described more fully hereinafter.

Section 12 includes an offset bore 19 which is offset by an angle A (FIG. 1) from the longitudinal center line 20 of the drill string bore. The axis of the bore 19 is designated by the numeral 21 in FIG. 1. The bore 19 carries a sliding sleeve 22 having an upper end portion 23 with a circumferentially extending collar 24. The collar 24 carries a pair of O-rings 25 for forming a seal with the walls of bore 19, as shown in FIG. 2. The lower end portion 26 of sleeve 22 is threaded for forming a connection with section 13, as shown in FIGS. 2 and 3. Collar 24 rests on shoulder 27 of middle section 12 when tool 10 is in the position shown in FIG. 2.

The lower section 13 is thus able to rotate with respect to the section 12 such as, for example, when a drill is rotated in one rotational direction or the other. One skilled in the art will also notice that the section 12 moves longitudinally with respect to the section 13, as is seen by an examination of FIGS. 2 and 3. The combination of rotating the drill string in one direction or the other by use of a drill motor and the extension of the section 13 with respect to the section 12, provides a means for locking the angular position of the section 13 with respect to the section 12 in two different positions. In one position, the section 13 is angled with respect to the section 12 so that the drill can directionally drill. In the other position, the sections 12 and 13 are axially aligned along a straight line.

The method of rotating the angular orientation between the upper member 12 and the lower member 13 is disclosed more particularly in my prior United States Patents which have been incorporated herein by reference. This application is an improvement to those patents in that it relates to an improved locking mechanism which can lock the apparatus in either a straight drilling or a directional drilling position as desired by combining the rotational torsion imparted to the drill string by the drill motor with the longitudinal movement of the apparatus, such as when the drill string weight is collapsed upon the drill motor so that the apparatus assumes the position shown in FIG. 2 with the section 12 engaging and forming a connection with the section 13.

Figure 11:
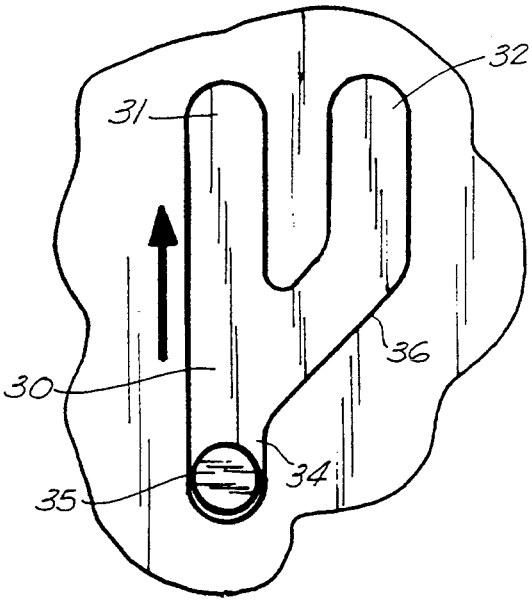
Figure 12:
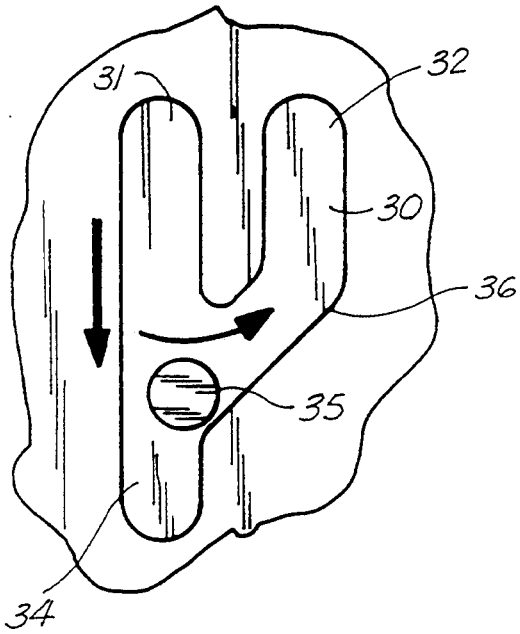
Figure 13:
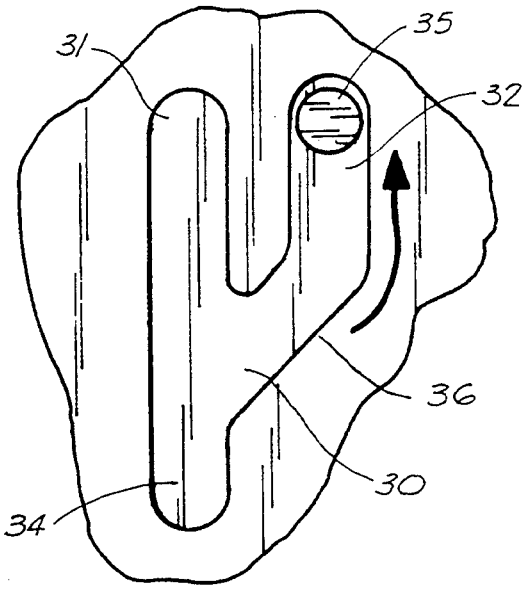

The improved locking mechanism, as best seen in FIGS. 1–3, as including a slot 30 having a pair of upper slot portions 31, 32 separated by a rib 33 and communicating with a common lower slot portion 34, which in FIG. 2, is occupied by a locking pin 35. When the drill string is lifted, the upper section 11 raises the section 12 upwardly so that the sections 12 and 13 separate, as shown in FIG. 2. Because the slot 30 has a single lower portion 34, the locking pin 35 is guided downwardly to the position shown in FIG. 2. Notice that the slot includes an inclined curved portion 36 which always registers the locking pin 35 in the position shown in FIGS. 2, 7, and 11, no matter whether the locking pin was in slot 31 or 32. In this position, the apparatus 10 is in an axial or straight drilling position in that the central longitudinal axis of member 13 and the central longitudinal axis of member 12 is vertically aligned.

Figures 6, 7, 8, 9:
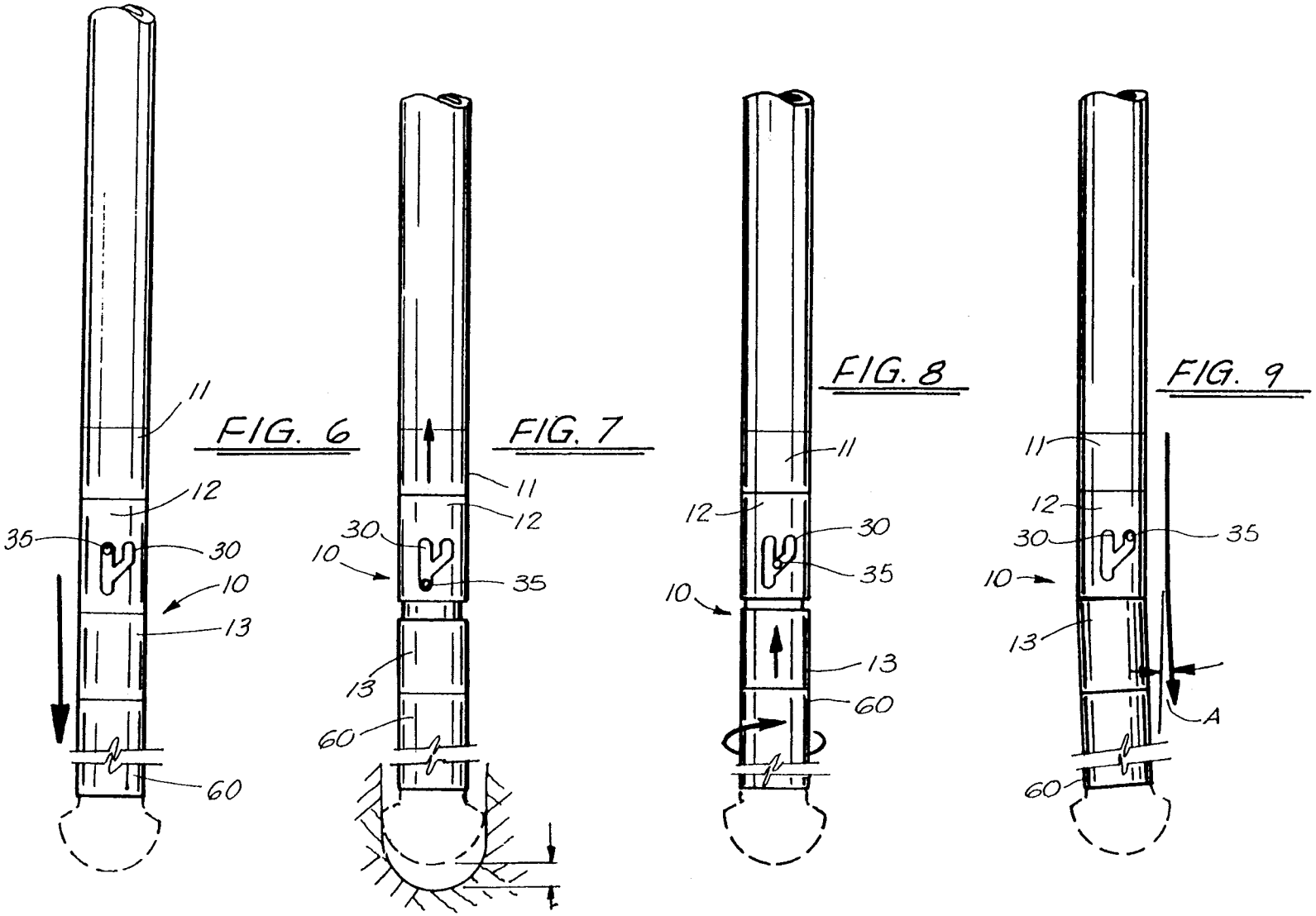
FIG. 6 is a side view of the apparatus of the preferred embodiment of the present invention going downhole.
FIGS. 7 and 8 are side views of the apparatus of the present invention showing the apparatus shifting from a straight drilling position to a directional-drilling position.
FIG. 9 shows the apparatus of the present invention in a directional-drilling position.
Figure 10:
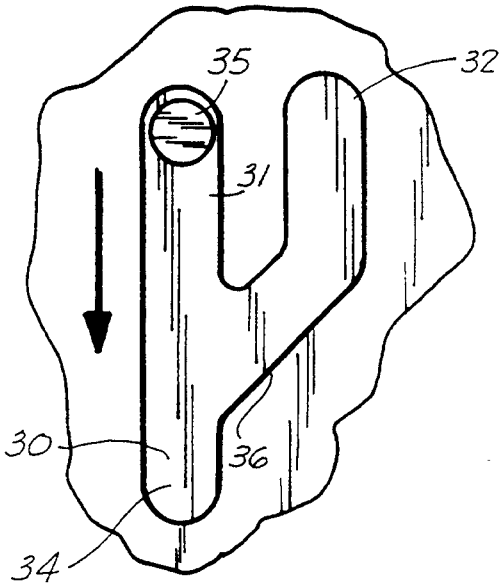
FIGS. 10–13 are close-ups of portions of FIGS. 6–9, respectively.

By rotating mud motor 60 in the desired rotational direction (see FIG. 8), torsion can be imparted to the drill string so that the pin 35 moves to the slot 32 when the members 12 and 13 are collapsed. If no torsion is imparted to the drill string, the locking pin 35 simply moves vertically upwardly into the slot 31, as shown in FIGS. 3, 6, and 10. Thus, a combination of raising and lowering of the drill string and of torsion imparted to the drill string by mud motor 60, can be used to move the tool between directional drilling and straight drilling positions.

Figure 4:
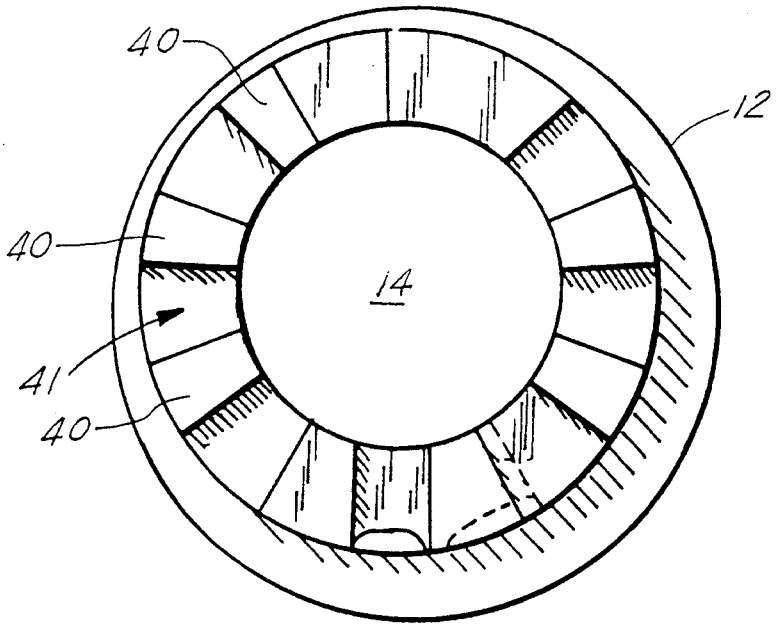
FIG. 4 is a horizontal sectional view of the preferred embodiment of the apparatus of the present invention.
Figure 5:
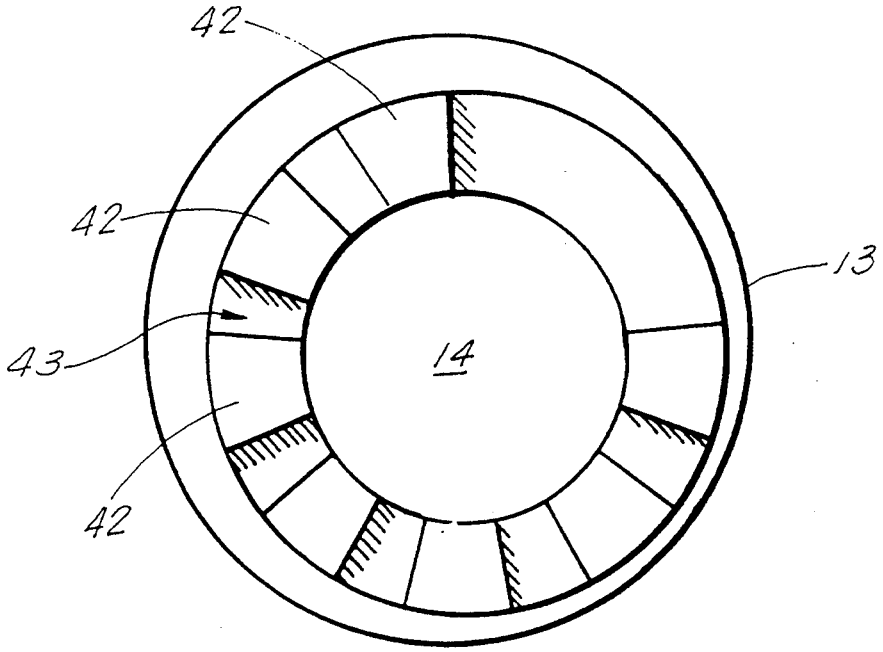
FIG. 5 is a top view of the preferred embodiment of the apparatus of the present invention illustrating the locking teeth portion thereof.

In order to lock the device in either a straight drilling or a directional drilling (angled) position, multiple locking teeth are provided on each section 12 and 13. Thus, in FIG. 1, the section 12 includes a plurality of teeth 40 which can engage with the teeth 42 of the section 13. Between the teeth 40 are squared recesses 41 which are sized to register with and form a connection with the teeth 42. Similarly, the section 13 includes a plurality of recesses 43 between the teeth 42 which are receptive of the teeth 40 (see FIGS. 4 and 5.)

A piston 50 is mounted atop sleeve 22 and provides a small lower portion 51 which registers with the bore 52 of sleeve 22. O-rings 53, for example, can be used to form a seal between the lower portion 51 and the bore 52. An upper enlarged portion 54 of piston 50 forms a seal with and closes the top 24 of sleeve 22.

The apparatus 110 of the second embodiment of the present invention provides an indication to the well operator of the status of the directional drilling tool, i.e., whether it is in a straight or bent-sub position.

Apparatus 110 of the second embodiment of the present invention (see FIG. 14) includes an upper tool body 111 having locking jaws 112 which register in correspondingly shaped recesses 112A of the lower tool body 116. A through bore 113 communicates fluid throughout the lower tool body and is in fluid communication with a similar through bore of the upper tool body. Both the upper and lower tool bodies are designed to be lowered in a well bore upon a work string, tool string or the like.

A pair of spaced apart pushrods 122 each provide upper end portions that extend from pushrod chambers 138. When the tool shifts into a bent orientation, the locking jaws 112 register in the upper end portion of the pushrod chamber 138 engaging the upper end portion of each pushrod 122 as shown in FIG. 15.

The lower end 117 of the tool body carries a movable piston 118 having a through bore 113A that communicates with the through bore 113 of the lower tool body 116. The lower end portion of piston 118 is open, defining jet 120 and piston 118 is urged upwardly with piston spring 121. Each pushrod 122 provides a beveled surface portion 123 adapted to engage locking pistons 125. The locking pistons 125 are positioned inside openings 124 of the lower tool body 116.

Figure 14:
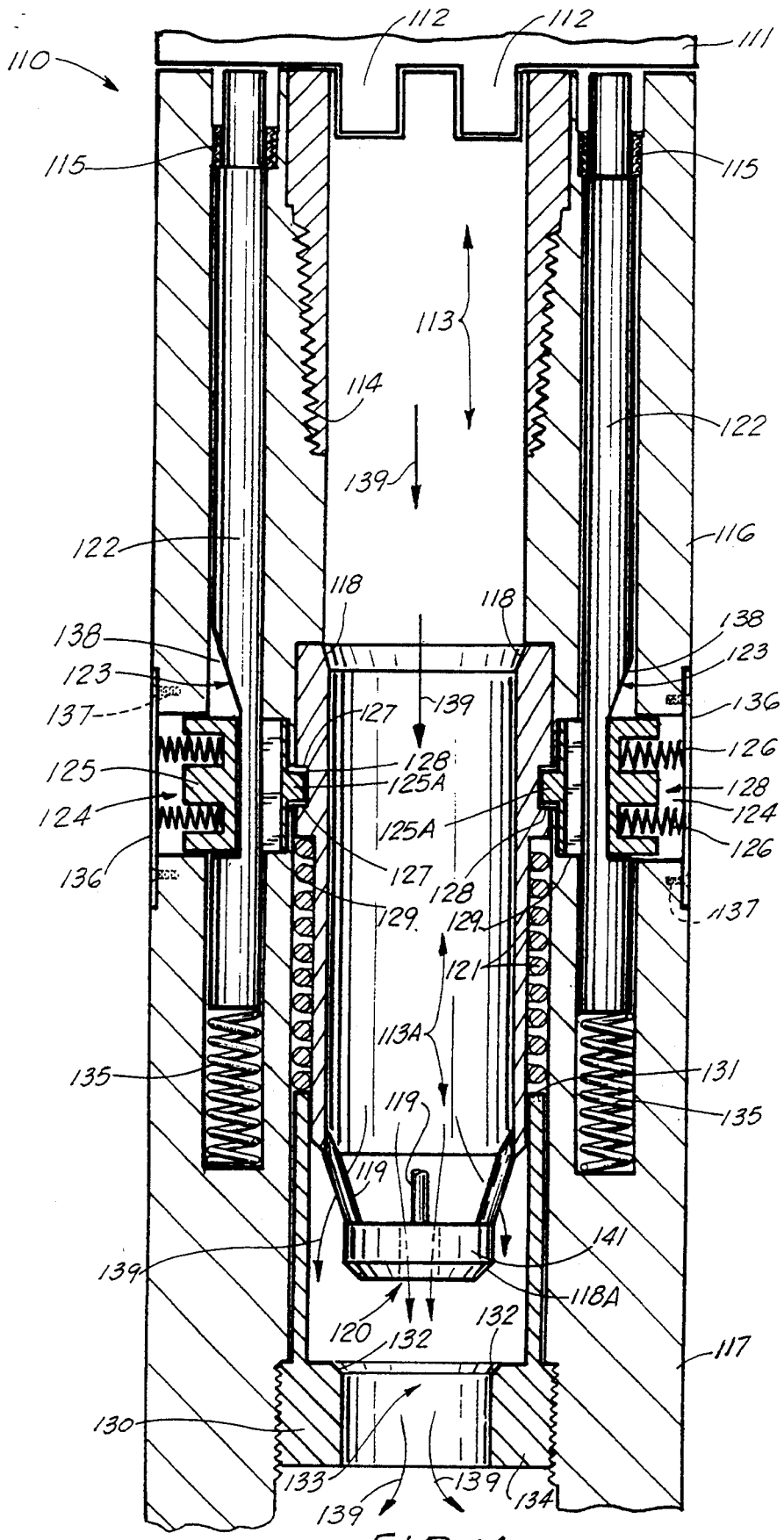
FIG. 14 is a sectional elevational view of a second embodiment of the apparatus of the present invention in a straight position.

A plurality of laterally extending springs 126 are positioned between the locking pistons 125 and seal cap 136. Annular shoulder 127 of piston 118 defines a recess 128 with shoulder 129 of piston 118. Each locking piston 125 has a projecting piston lock member 125A that engages the recess 128 of piston 118. Valve body 130 includes an annular stop portion 131 that is abutted on its upper surface by spring 121. The valve body includes a valve seat 132 and valve seat opening 133. Valve hub 134 is the main portion of the valve body and the lowermost portion thereof. A pushrod spring 135 associated with each pushrod 122 urges each pushrod 122 into the uppermost position as shown in FIG. 14.

Figure 15:
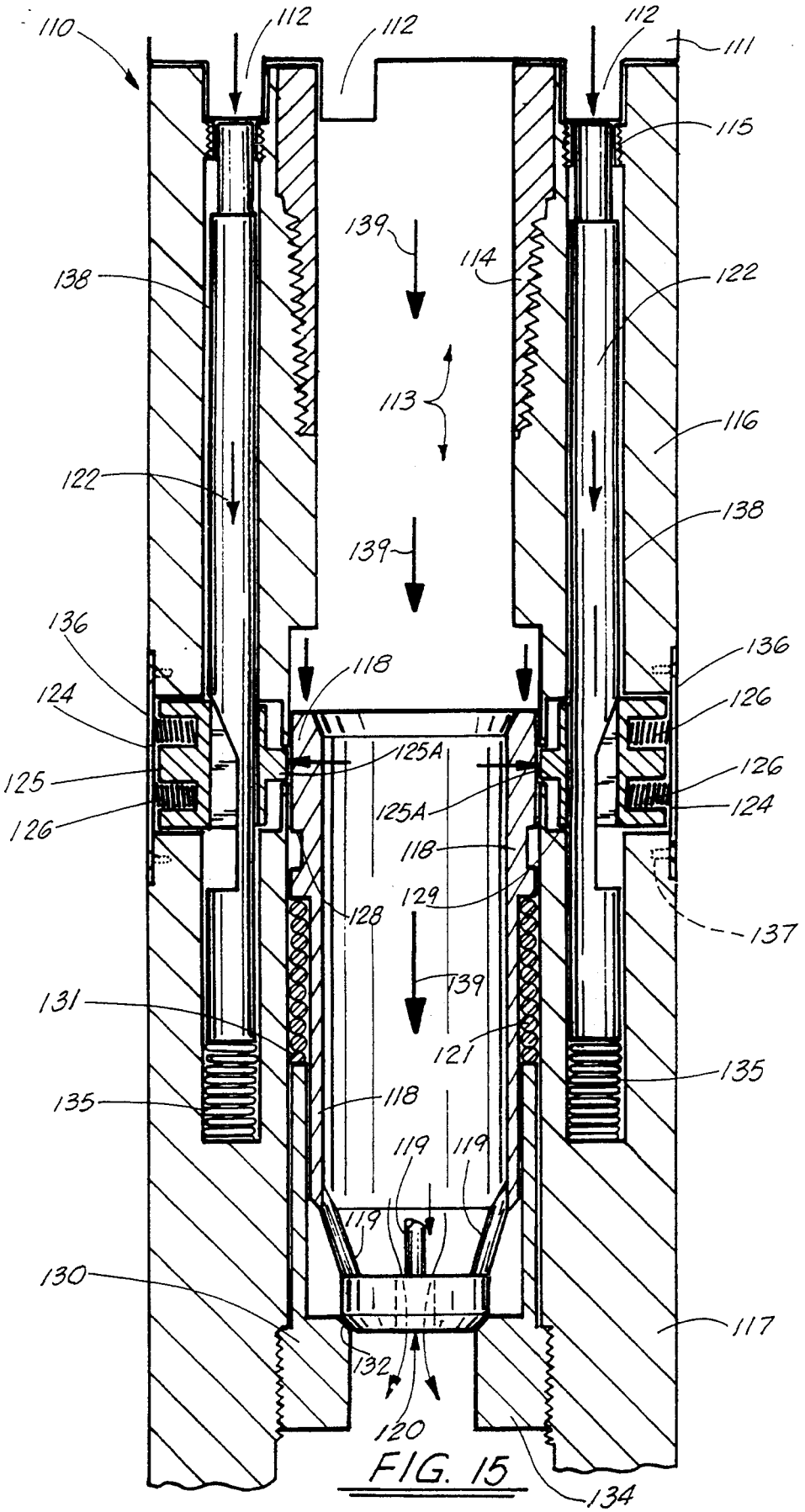
FIG. 15 is a sectional elevational view of the second embodiment of the apparatus of the present invention showing the apparatus in a bent position.

In FIG. 15, the upper tool body has moved into a downward or bent sub position, depressing the pushrods 122 downwardly as shown by the arrows 139 in FIG. 15. This downward movement shifts the beveled section of each pushrod 122 so that it moves the locking pistons 125 laterally away from each pushrod chamber 138 as shown in FIG. 15. This also disengages the locking pistons 125 from recess 128 of piston 118 as shown in FIG. 15, and allows piston 118 to move downwardly as shown by the arrows 139. This downward movement also seats the lower end 118A of piston 118 upon seat 132 as shown in FIG. 15.

The apparatus of the second embodiment of the present invention provides an indicator designed and adapted to be lowered with a bent-sub tool. It informs the driller on the surface of the position of the tool, i. e. whether it is straight or bent. In FIG. 14, the tool is in a straight position. This allows flow through and around the valve disc 141. In FIG. 15, the indicator shows the tool in bent position. When the tool is moved into the bent position, the locking jaws 112 press down on the pushrods 122, forcing the locking pistons 125 out and allowing mud pressure to force the restricting piston 118 down until the valve disc 141 seats upon the valve seat 132. This forces drilling mud through the jet 120. This restricts flow which increases mud pressure on the pump gauge at the surface. This increase in mud pressure thus assures the driller that the tool is in the bent-sub position so that drilling can continue.

When the tool is moved back to a straight position, the above procedure is reversed, and a decrease in mud pressure informs the driller at the surface that the tool has been moved back to a straight position.

Tool 110, shown in FIGS. 14 and 15, can be used with tool 10, shown in FIGS. 1–13. In such a case, the lower tool body 116 of tool 110 would take the place of lower section 13 of the tubular body of apparatus 10. Teeth 112 in such a case would comprise teeth 40 and body 111 would comprise middle section 12, and one tooth 40 on each side of middle section 12 would be removed so that, when the apparatus 10 is in the straight position, no tooth 40 aligns with push rods 122, so that push rods 122 are not compressed, but are allowed to rise as shown in FIG. 14. Thus, when apparatus 10 is in the straight position, push rods 122, and piston 118, are in the up position, thus indicating to the operator at the surface that apparatus 10 is in the straight position. When apparatus 10 is used with apparatus 110 and apparatus 10 is in the bent position, then push rods 122 are pressed down by teeth 40 of middle section 12 of apparatus 10, and piston 118 is lowered, causing an increase in pressure which indicates to the operator at the surface that apparatus 10 has been moved to the bent position.

In order to allow free flow of mud through apparatus 110, lift off bottom, cut off pumps, and spring 121 will push piston back to the upper position shown in FIG. 14.

Optionally, to prevent fluid flow along push rods 122, there can be two spaced-apart O-rings (not shown) on each push rod 122, preferably recessed in grooves (not shown) surrounding push rods 122.

Although J-slot 30 is shown as having an open bottom in FIGS. 1–3 and a closed bottom in FIGS. 6–13, it could be made either way.

PARTS LISTS

The following table lists the part numbers and part description as used herein and in the drawings attached hereto.

| PART NO. | DESCRIPTION |
|---|---|
| 10 | Directional drilling apparatus |
| 11 | uppermost section |
| 12 | middle section |
| 13 | lower section |
| 14 | continuous tubular bore |
| 15 | threaded section |
| 16 | threaded section |
| 17 | uppermost threaded portion |
| 18 | lowermost end portion |
| 19 | offset bore |
| 20 | longitudinal center line |
| 21 | bore axis |
| 22 | sliding sleeve |
| 23 | upper end portion |
| 24 | circumferentially extending collar |
| 25 | O-rings |
| 26 | lower end portion |
| 27 | shoulder |
| 30 | slot |
| 31 | upper slot portion |
| 32 | upper slot portion |
| 33 | rib |
| 34 | common lower slot portion |
| 35 | locking pin |
| 36 | inclined curved portion |
| 40 | teeth |
| 41 | squared recesses |
| 42 | teeth |
| 43 | recesses |
| 50 | piston |
| 51 | small lower portion |
| 52 | bore |
| 53 | O-rings |
| 54 | upper enlarged portion |
| 60 | mud motor |
| 110 | Apparatus |
| 111 | upper tool body |
| 112 | locking jaws |
| 112A | recesses |
| 113 | bore |
| 113A | through bore |
| 114 | connection pin |
| 115 | retainer |
| 116 | lower tool body |
| 117 | lower end |
| 118 | piston |
| 118A | lower end |
| 119 | connecting arms |
| 120 | jet |
| 121 | spring |
| 122 | push rod |
| 123 | beveled surface |
| 124 | side opening |
| 125 | locking piston |
| 125A | piston lock |
| 126 | lateral springs |
| 127 | shoulder |
| 128 | recess |
| 129 | shoulder |
| 130 | valve body |
| 131 | annular stop |
| 132 | valve seat |
| 133 | valve seat opening |

-continued

| PART NO. | DESCRIPTION |
|---|---|
| 134 | valve hub |
| 135 | pushrod spring |
| 136 | seal cap |
| 137 | cap screw |
| 138 | pushrod chamber |
| 139 | arrows |
| 141 | valve disk |

In view of the numerous modifications which could be made to the preferred embodiments disclosed herein without departing from the scope or spirit of the present invention, the details herein are to be interpreted as illustrative and not in a limiting sense.

What is claimed as invention is:

1. A directional drilling apparatus comprising:

a) a two part tubular body including an upper section and a lower section adapted to rotate with respect to one another;

b) the upper section including means for attaching the apparatus to a drill string;

c) the upper section including at its lower end portion a slot including a straight portion which is generally aligned with the axis of the upper section and an offset portion which is spaced laterally from and spaced radially from the vertical section;

d) connecting means for forming a connection which rigidly affixes each of the upper and lower section with respect to each other so that they are prevented from rotating with respect to one another;

e) a sleeve carried by the lower section and slidably movable with respect to the upper section, the sleeve including a locking pin which extends into the slot, the pin being adapted to move longitudinally and laterally within at least a portion of the slot and into either the vertical or laterally offset a section thereof.

2. The apparatus of claim 1 wherein the sleeve allows the lower section to rotate with respect to the upper section.

3. The apparatus of claim 1 wherein the upper section includes a longitudinal bore which is offset from the central longitudinal axis of the drill string by an angular deviation of one or more degrees.

4. The apparatus of claim 3 wherein the lower section rotates with the sleeve between angled and straight positions so that the lower section is axially aligned with the drill string in one rotational position and axially offset from the drill string by an angle of at least one degree in the section rotational position.

5. The apparatus of claim 1, further comprising indicating means for indicating whether the apparatus is in a bent position or in a straight position.

6. The apparatus of claim 5, wherein the indicating means includes a movable sleeve.

7. The apparatus of claim 5, wherein the indicating means includes pushrods connected to a movable sleeve.

8. The apparatus of claim 5, wherein the indicating means includes pushrods connected to a movable sleeve, and the connecting means comprises locking teeth carried by the upper and lower sections, some of the teeth on the upper section pressing down on the pushrods when the apparatus is in the bent position.

9. The apparatus of claim 1, wherein:

the connecting means comprises locking teeth carried by the upper and lower sections.

10. A directional drilling apparatus comprising:

a) a two part tubular body including an upper section and a lower section adapted to rotate with respect to one another;

b) the upper section including means for attaching the apparatus to a drill string;

c) the upper section including at its lower end portion a slot including a straight portion which is generally aligned with the axis of the upper section and an offset portion which is spaced laterally from and spaced radially from the vertical section;

d) connecting means for forming a connection which rigidly affixes each of the upper and lower section with respect to each other so that they are prevented from rotating with respect to one another; and e) indicating means for indicating whether the apparatus is in a bent position or in a straight position.

11. The apparatus of claim 10, wherein the indicating means includes a movable sleeve.

12. The apparatus of claim 10, wherein the indicating means includes pushrods connected to a movable sleeve.

13. The apparatus of claim 10, wherein the indicating means includes pushrods connected to a movable sleeve, and the connecting means comprises locking teeth carried by the upper and lower sections, some of the teeth on the upper section pressing down on the pushrods when the apparatus is in the bent position.

* * * * *